US005832967A

United States Patent [19]

Andersson

[11] Patent Number: 5,832,967

[45] **Date of Patent: *Nov. 10, 1998**

[54] VAPOR RECOVERY SYSTEM AND METHOD UTILIZING OXYGEN SENSING

[75] Inventor: Bo-Göran Andersson, Salisbury, Md.

[73] Assignee: Dresser Industries, Inc., Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 696,167

[22] Filed: Aug. 13, 1996

[51] Int. Cl.[6] ..... B67D 5/378

[52] U.S. Cl. ..... 141/59; 141/7; 141/83; 141/94; 141/290; 73/23.2

[58] Field of Search ..... 141/5, 7, 59, 83, 141/94, 290; 73/23.2

[56] References Cited

U.S. PATENT DOCUMENTS 4,057,086 11/1977 Healy .
4,095,626 6/1978 Healy .
4,153,025 5/1979 Thornburgh .
4,836,835 6/1989 Harris et al. .
5,038,838 8/1991 Bergamini et al. ..... 141/59
5,040,577 8/1991 Pope .
5,209,275 5/1993 Akiba et al. ..... 141/83
5,244,022 9/1993 Gimby .
5,267,721 12/1993 Stroh .
5,269,353 12/1993 Nanaji et al. .
5,280,814 1/1994 Stroh .
5,305,807 4/1994 Healy ..... 141/59
5,322,008 6/1994 Todd et al. .
5,507,325 4/1996 Finlayson ..... 141/83
5,627,306 5/1997 Yamauchi et al. ..... 73/23.2

*Primary Examiner*—J. Casimer Jacyna
*Attorney, Agent, or Firm*—Haynes and Boone, L.L.P.

[57] ABSTRACT

A system and method for recovering a gasoline vapor/air mixture from a vehicle tank during the dispensing of gasoline from a storage tank into the vehicle tank in which the flow of the mixture from the vehicle tank to the storage tank is induced during the dispensing of the gasoline. The amount of oxygen in the mixture is sensed and the flow of the mixture is shut off when the oxygen content in the mixture attains a predetermined value.

5 Claims, 2 Drawing Sheets

VAPOR RECOVERY SYSTEM AND METHOD UTILIZING OXYGEN SENSING

BACKGROUND OF THE INVENTION

This invention relates to a gasoline dispensing and vapor recovery system and method and, more particularly, to such a system and method for controlling the flow of a mixture of gasoline vapor and air from a vehicle fuel tank as it is being filled with gasoline.

A number of systems and methods have been proposed for controlling the flow of a mixture of air and hydrocarbon vapors (hereinafter referred to as "vapor/air mixture") displaced from a vehicle tank during the dispensing of gasoline into the vehicle tank at a service station, or the like, in order to reduce vapor emissions at the interface between the vehicle and the dispensing nozzle. In general, gasoline dispensing and vapor recovery systems and methods of this type include a plurality of dispenser housings with each housing being connected to an underground storage tank for gasoline. Each dispenser housing has one or more nozzles for dispensing the gasoline into a vehicle fuel tank, and passages are provided in each nozzle for collecting the vapor/air mixture from the vehicle tank. A return line is connected to the vapor/air mixture passage for delivering the collected vapor/air mixture back to the underground fuel storage tank.

Some of these systems and methods, often termed passive systems, rely solely upon vapor/air mixture pressure within the fuel tank to force the vapor/air mixture through the vapor/air mixture return line. However, due to pressure losses and partial obstructions in the vapor/air mixture recovery line (sometimes caused by fuel splash back or condensation), the vapor/air mixture pressure developed in the vehicle fuel tank was often insufficient to force the vapor/air mixture out of the vehicle tank and to the underground storage tank.

To eliminate this problem, "active" vapor recovery systems and methods have evolved that employ a vacuum pump for drawing the vapor/air mixture from the vehicle tank and through a vapor/air mixture return line. Some of these systems provide a relatively powerful, continuously-operating, vacuum pump and a valve arrangement for connecting the various vapor/air mixture return lines to the vacuum pump. According to other active systems, a vacuum pump is provided at each dispenser housing which is driven by the dispensing unit's conventional gasoline flow meter and which is connected to a vapor/air mixture return line.

Recently government-promulgated rules require, or will require, that onboard vapor recovery systems (ORVR) be installed on at least a portion of gasoline-operated vehicles. These systems are designed to capture and retain the gasoline vapors generated during refueling in an activated carbon canister located on the vehicle. The vapors captured in the canister will then be burned in the engine during normal driving.

Although the ORVR systems will render the above-mentioned vapor recovery systems unnecessary, the latter systems must remain in operation to service the vehicles not equipped with the ORVR systems. Therefore, when an ORVR-equipped vehicle is serviced, the vapor recovery systems will ingest some air to replace the fuel withdrawn from the storage tank. This upsets the dynamic equilibrium in the system and causes some of the gasoline in the storage tank to evaporate. The resulting gasoline vapors "grow" until dynamic equilibrium is regained and the mixture becomes saturated. This evaporation, or vapor growth will often cause the volume of vapor in the storage tank to exceed the capacity of the system, and significant quantities of the gasoline vapor will be discharged into the atmosphere through a vent pipe associated with the storage tank. This reduces the efficiency of the gasoline dispensing system and pollutes the atmosphere.

Another major problem that is caused by a significant quantity of air being present in the vapor/air mixture recovered by the vapor recovery system and introduced into the storage tank is that the mixture may be flammable and cause flame propagation if a flame, or spark, is initiated, which could be disastrous. More particularly, if the percentage of vapors present in the vapor/air mixture in the vapor recovery system is within a certain range, flame propagation can occur. For example, it is well documented that, with respect to most gasolines dispensed at service stations, flame propagation can occur if the percentage of vapors in the vapor/air mixture is between approximately 2%–8%, i.e., the percentage of air in the vapor/air mixture is between approximately 92%–98%. (If the percentage of vapors falls below approximately 2% (more than 98% air), then the danger of flame propagation severely diminishes due to the lack of gasoline in the mixture.)

Therefore, what is needed is an active vapor recovery system in which the amount of air in the vapor/air mixture in the vapor recovery system is detected and, if in excess of a predetermined value, the vapor recovery system will be cut off.

SUMMARY OF THE INVENTION

The present invention, accordingly, is a system and method for recovering vapors from a vehicle tank during the dispensing of gasoline into the tank in which the above problems caused by the ingestion of too much air into the system are eliminated. More particularly, according to the system and method of the present invention, a sensor is provided which detects the amount of oxygen, and therefore air, in the vapor recovery system and, when the amount attains a predetermined value, the flow of the mixture into the underground storage tank is terminated.

The system and method of the present invention thus enjoy the advantage of eliminating the accumulation of air in the vapor recovery system and the storage tank to the extent that it causes the problems set forth above.

DESCRIPTION OF THE PREFERRED EMBODIMENT

Figure 1:
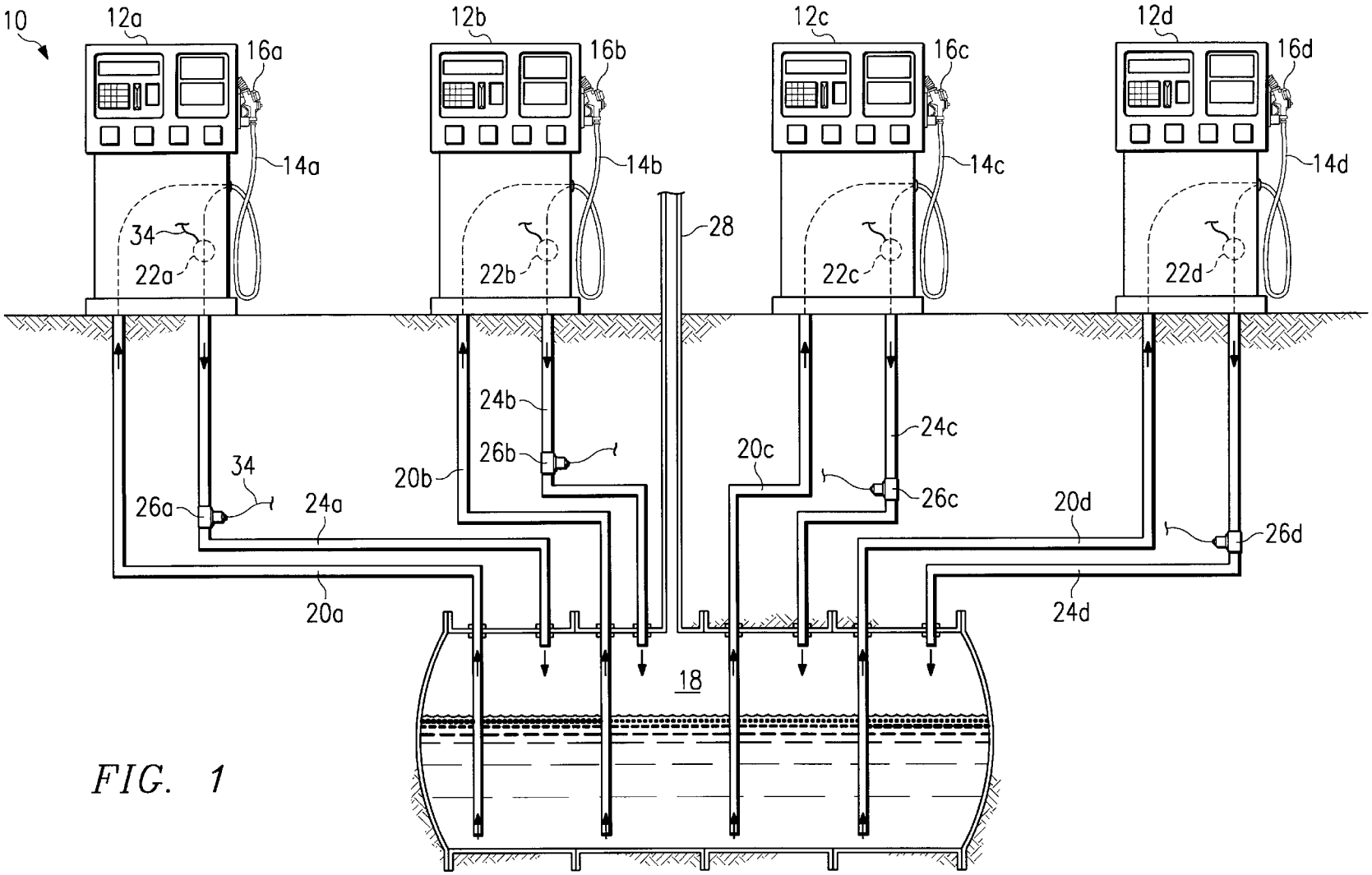
FIG. 1 is a schematic view of the system of the present invention.

Referring to FIG. 1 of the drawings, the reference numeral 10 refers, in general, to a service station for dispensing gasoline to vehicles. To this end, four dispenser housings 12*a*–12*d* are provided which are respectively provided with hose assemblies 14*a*–14*d* which, in turn, have dispensing nozzles 16*a*–16*d,* respectively, affixed to one end thereof.

An underground gasoline storage tank 18 is provided immediately below the dispenser housings 12*a*–12*d* and is connected by four flow lines 20*a*20*d* to the dispenser housings 12*a*–12*d,* respectively. Although not shown in the drawings for the convenience of presentation, it is understood that one or more pumps and flow meters are associated with the flow lines 20*a*–20*d* for pumping the gasoline to the dispenser housings 12*a*–12*d* and for metering the flow of the gasoline, respectively. As shown schematically in the drawing, the flow lines 20*a*–20*d* are connected to the hose assemblies 14*a*–14*d* in the interior of the dispenser housings 12*a*–12*d,* for passing the fuel to the dispensing nozzles 16*a*–16*d,* respectively, for discharging the gasoline into the fuel tanks of vehicles being serviced.

It is also understood that each hose assembly 14*a*–14*d* includes two flow lines, or hoses, connected to their respective dispensing nozzles 16*a*–16*d* for respectively dispensing the gasoline through one of the hoses and for receiving the displaced vapor/air mixture from the vehicle tank in the other hose, as will be described.

Four flow-inducing members, in the form of vacuum pumps 22*a*–22*d,* are located in the interior of the dispenser housings 12*a*–12*d,* respectively. As shown schematically in the drawing, the vacuum pumps 22*a*–22*d* are connected to the vapor recovery hoses of the respective hose assemblies 14*a*–14*d* in the interior of the dispenser housings 12*a*–12*d,* respectively, for drawing the vapor/air mixture from the vehicle tanks through the nozzles 16*a*–16*d,* respectively. It is understood that each vacuum pump can be controlled by a controller (not shown) and that a switch, or the like, is provided on each dispenser housing 12*a*–12*d* which, when actuated preparatory to dispensing gasoline into the vehicle tank to be serviced, actuates both the vacuum pump 22*a*–22*d* and the gasoline pump (not shown) associated with each flow line 20*a*–20*d,* respectively. Since this type of switch and controller are well known, they are not shown and will not be described in detail.

Four vapor recovery flow lines, or conduits, 24*a*–24*d* are also connected to the vacuum pumps 22*a*–22*d,* respectively, and extend to the underground storage tank 18 for passing the recovered mixture to the tank. Four oxygen sensors 26*a*–26*d* are connected in the vapor recovery flow lines 24*a*–24*d,* respectively, in a manner to be described, for detecting the quantity of oxygen that is present in the vapor/air mixture recovered from the vehicle tank and flowing through the flow lines 24*a*–24*d.*

A vent pipe 28 extends from the underground storage tank 18 to a height above ground for the purpose of venting the latter tank when the fluid pressure in the tank exceeds a predetermined value, as will be explained.

Figure 2:
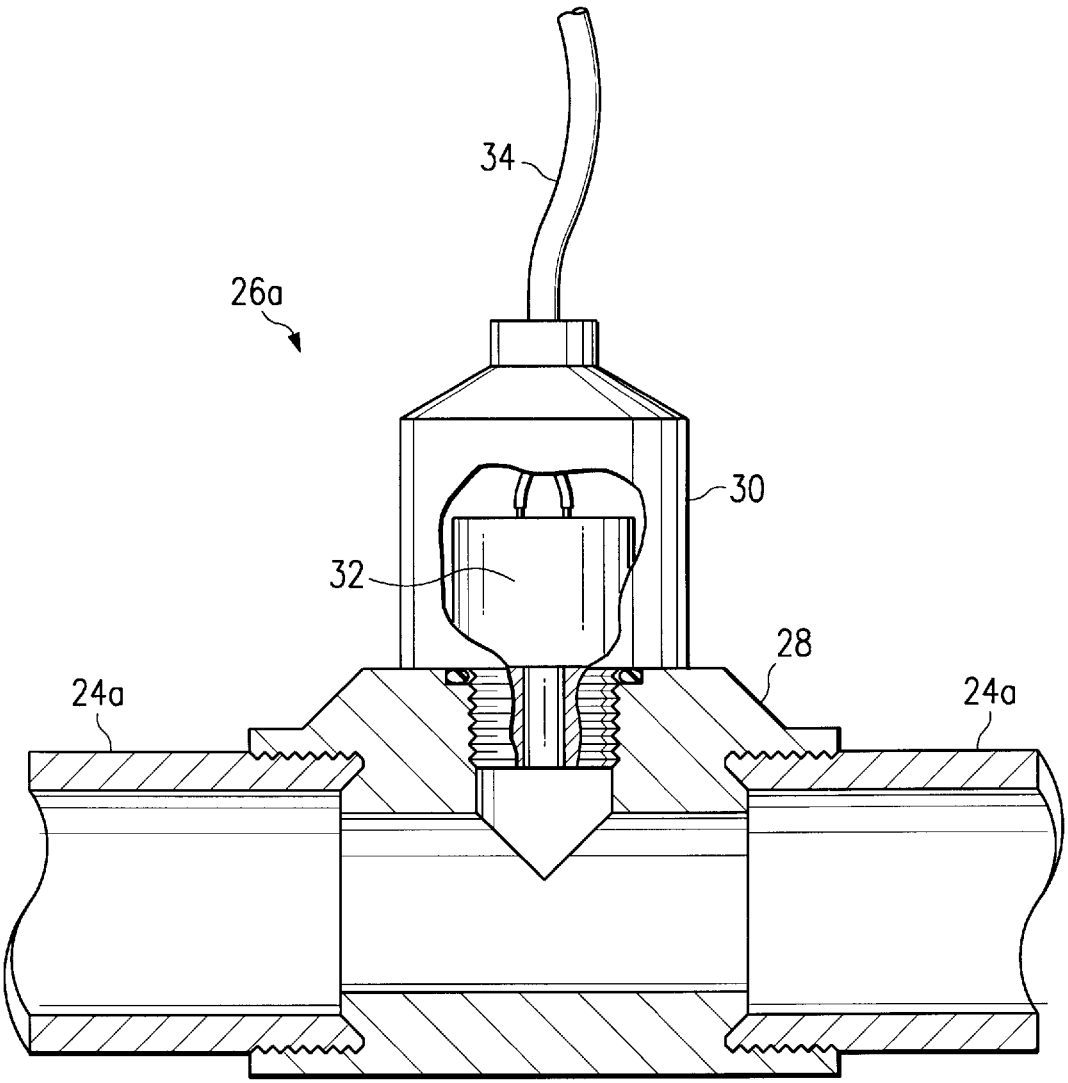
FIG. 2 is an enlarged sectional/elevational view of the oxygen sensor utilized in the system FIG. 1.

The details of the oxygen sensor 26*a* are shown in FIG. 2, it being understood that the other sensors 26*b*–26*d* are identical. More particularly, the sensor 26*a* consists of a "Tee" type fitting 28 having a bore, the end portions of which are enlarged in diameter to respectively receive two sections of the vapor recovery flow line 24*a*. It is understood that the sections of the flow line 24*a* can be secured in the fitting 28 in any known manner, such as by providing cooperating threads on the sections and on the fitting.

The sensor 26*a* also includes a housing 30 that rests on the fitting 28, and a probe 32 having a portion extending inside the housing and another portion projecting from the housing, through a port formed through the fitting, and into the bore of the fitting. The probe 32 operates in a conventional manner to detect the oxygen content of the air in the vapor/air mixture passing through the flow line 24*a*. It is understood that the housing 30 also contains electronics for responding to the output of the probe 32 and for generating an output signal when the oxygen, and therefore the air, content of the mixture attains a predetermined value. These electronics can include a micro-processor, or the like, and since they are conventional, they will not be described in any further detail.

It is understood that the oxygen sensors 26*a*–26*d* can be of any conventional type such as the model AO2 Molex Citicel® sold by City Technology Limited of Portsmouth, England; the CAG series sold by Ceramatec of Salt Lake City, Utah; or Models R21A or R22A sold by Sensor Technologies of City of Industry, Calif.

A signal cable 34 extends from the housing 30 and to the dispenser housing 12*a* (FIG. 1) where it is connected to the vacuum pump 22*a,* or its controller, so that the pump receives the output signals from the sensor 26*a.* The design is such that the vacuum pump 22*a* is normally turned on when the operator trips a switch at the dispenser housing 12*a* prior to dispensing gasoline into the vehicle, and that the signal received from the sensor 26*a* switches the pump off. Since these types of switching functions are well known, they will not be described in any further detail.

In operation, and assuming that a vehicle is to be serviced by the dispenser housing 12*a,* the nozzle 16*a* is inserted into the vehicle tank and actuated, causing gasoline to flow from the storage tank 18, through the flow line 20*a* and one of the hoses in the hose assembly 14, to the nozzle 16*a,* and into the vehicle tank. Actuation of the nozzle 16*a* also actuates the vacuum pump 22*a* as described above and, as a result, a mixture of gasoline vapor and air in the vehicle tank is displaced from the tank by the combined action of the gasoline entering the tank and the vacuum pump 22*a.*

As the mixture flows through the flow line 24*a* from the vehicle tank to the storage tank 18, the amount of the oxygen, and therefore the amount of air, in the vapor/air mixture is detected by the sensor 26*a.* If the vehicle being serviced is not equipped with an ORVR (described above), then the percentage of air in the gasoline vapor/air mixture recovered from the vehicle tank, as detected by the sensor 26*a,* is usually in equilibrium with the vapor/air mixture in the storage tank 18 and therefore not sufficient to cause evaporation, or vapor growth, in the storage tank 18 of a magnitude sufficient to over-pressurize the tank and cause an undue amount of discharge of the mixture into the atmosphere through the vent pipe 28, as discussed above. Similarly, the air content in the mixture is also not high enough to cause the mixture to be flammable. Thus, under these conditions the sensor 26*a* maintains the vacuum pump 22*a* in its operable condition.

However, if the vehicle is equipped with an ORVR which removes a substantial portion of the gasoline vapor from the mixture at the vehicle, as described above, then the percentage of air, and therefore oxygen, in the mixture is significantly higher. Accordingly, the sensor 26*a* is calibrated so that it will generate a signal if the percentage of air in the mixture attains a predetermined value sufficient to cause the vapor/air mixture to be flammable. (As stated above, this flammable range of air in the mixture is approximately 92%–98% with respect to most gasolines dispensed at service stations.) This signal is passed, via the cable 34, to the vacuum pump 22*a* and switches the pump off.

It is understood that the sensor 26*a* can also be calibrated to shut off the vacuum pump 22*a* if the amount of oxygen in the gasoline vapor/air mixture recovered from the vehicle tank is out of equilibrium with the vapor/air mixture in the storage tank 18 such that excessive evaporation, or vapor growth, occurs. This will prevent the storage tank 18 from becoming over-pressurized thus causing discharge of excessive amounts of the mixture, which includes a large percentage of gasoline vapor, into the atmosphere through the vent pipe 28.

After the vacuum pump 22*a* is switched off in the above manner, a relatively small amount of vapor/air mixture is recovered during the additional dispensing of gasoline into the vehicle tank. Of course, after the nozzle 16*a* is returned to the dispenser housing 12*a,* the gasoline pump, the vacuum pump 22*a,* and the sensor 26*a* are all reset for the next vehicle to be serviced.

It is understood that the dispenser housings 12*b*–12*d* and their associated components operate in a manner identical to that described above in connection with the housing 12*a*.

As a result of the above, the system and method of the present invention enjoy several advantages. For example, the accumulation of unacceptable amounts of air in the vapor recovery system is eliminated. Thus, excessive evaporation, or vapor growth, is eliminated thus eliminating the discharge of unacceptable amounts of gasoline vapor into the atmosphere. Also, the possibility of a hazardous mixture of oxygen and gasoline vapors accumulating in the underground storage tank is eliminated.

It is understood that several variations may be made in the foregoing without departing from the scope of the invention. For example, the present invention is not limited to shutting off the vacuum pump when the oxygen content mixture attains a predetermined finite value, but rather can be programmed to cut off the vacuum pump in response to a predetermined increase in the rate of change of the percentage of oxygen in the vapor/air mixture. More particularly, if the rate of increase of the percentage of the oxygen in the mixture reaches a predetermined value, such as 5% per second, the sensor can be programmed to shut off the vacuum pump. This situation could occur when a vehicle that is not equipped with an ORVR is serviced, thus leaving a vapor/air mixture having a relatively low oxygen content in the vapor recovery system, followed by a vehicle that is equipped with an ORVR.

Other variations that are possible within the scope of the present invention include the use of flow-inducing members other than vacuum pumps to induce the flow of the vapor/air mixture from the vehicle tank to the storage tank 18. Also, the vacuum pumps 22*a*–22*d,* or other flow-inducing members, can be in a location in the system of the present invention other than the location described above. Further, the sensors 26*a*–26*d* do not have to be connected in the flow lines 24*a*–24*d,* respectively, but can be located in the nozzles 16*a*–16*d,* the hose assemblies 14*a*–14*d,* the vacuum pumps 22*a*–22*d,* or the tank 18. Also, although the terms "flow line," "conduit," "hose," and "pipes" have been used above, it is understood that these terms can be used interchangeably and can be in the form of any type of flow line that permits the flow of the gasoline and the vapor/air mixture. Still further, more than one underground storage tank, similar to the tank 18, can be provided for storing different grades of gasoline and a blending chamber, or valve, can be included to regulate the volumetric ratio of relative low octane products, such as unleaded regular, and relatively high octane products, such as unleaded premiums, so as to make available multiple grades of fuel. Also, the number of vacuum pumps used in the system of the present invention can vary within the scope of the invention.

Still other modifications, changes and substitutions are intended in the foregoing disclosure and in some instances some features of the invention will be employed without a corresponding use of other features. Accordingly, it is appropriate that the appended claims are construed broadly and in a manner consistent with the scope of the invention.

What is claimed is:

1. A system for recovering a gasoline vapor/air mixture from a vehicle tank during the dispensing of gasoline from a storage tank into the vehicle tank through a nozzle; the system comprising a hose extending from the nozzle; a pump connected to the hose; a conduit extending from the pump to the storage tank so that the pump draws the vapor/air mixture from the nozzle and passes it through the hose and the conduit and to the storage member; and a sensor connected to the conduit at a location downstream of the pump for directly sensing the amount of oxygen in the mixture during its flow from the pump to the storage tank and for generating an output signal indicative of the amount of oxygen in the mixture at the location, the sensor being electrically connected to the pump for shutting off the pump when the sensed amount of oxygen attains a predetermined value.

2. A method for recovering a gasoline vapor/air mixture from a vehicle tank during the dispensing of gasoline from a storage tank, through a nozzle, and into the vehicle tank, the method comprising the steps of connecting the nozzle to a pump, connecting the storage tank to the pump, actuating the pump to pass the mixture from the vehicle tank, through the nozzle, and to the storage tank during the dispensing of the gasoline, directly sensing the amount of oxygen in the mixture during its flow from the pump to the storage tank, generating an output signal indicative of the amount of oxygen in the mixture flowing from the pump to the storage tank, and shutting off the pump when the sensed amount of oxygen attains a value such that the gasoline vapor content of the mixture extends within the flammability range of the gasoline vapor.

3. The method of claim 2 wherein the predetermined value is such that the vapor content of the mixture is greater than approximately 2% of the mixture.

4. A system for recovering a gasoline vapor/air mixture from a vehicle tank during the dispensing of gasoline from a storage tank into the vehicle tank through a nozzle; the system comprising a hose extending from the nozzle; a pump connected to the hose; a conduit extending from the pump to the storage member so that the pump draws the vapor/air mixture from the nozzle and passes it through the hose and the conduit and to the storage member; and a sensor connected to the conduit at a location downstream of the pump for directly sensing the amount of oxygen in the mixture at the location and for generating an output signal indicative of the amount of oxygen in the mixture at the location, the sensor being electrically connected to the pump for shutting off the pump when the rate of change of the sensed amount of oxygen attains a predetermined value.

5. A method for recovering a gasoline vapor/air mixture from a vehicle tank during the dispensing of gasoline from a storage tank, through a nozzle, and into the vehicle tank, the method comprising the steps of connecting the nozzle to a pump, connecting the storage tank to the vacuum, actuating the pump to flow the mixture from the vehicle tank, through the nozzle, and to the storage tank during the dispensing of the gasoline, directly sensing the amount of oxygen in the mixture during its flow from the pump to the storage tank, generating an output signal indicative of the amount of oxygen in the mixture flowing from the pump to the storage tank, and shutting off the pump when the rate of change of the sensed amount of oxygen attains a predetermined value.

* * * * *